US012006481B1

(12) United States Patent
Soliman et al.

(10) Patent No.: US 12,006,481 B1
(45) Date of Patent: Jun. 11, 2024

(54) METHODS OF WATER SEPARATION FROM CRUDE OIL

(71) Applicant: SAUDI ARABIAN OIL COMPANY, Dhahran (SA)

(72) Inventors: Mohamed Ahmed Soliman, Ras Tanura (SA); Azeb M. Qahtani, Dhahran (SA); Simone Less, Dhahran (SA); Ramsey White, Abqaiq (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/060,113

(22) Filed: Nov. 30, 2022

(51) Int. Cl.
*C10G 53/02* (2006.01)

(52) U.S. Cl.
CPC ..... *C10G 53/02* (2013.01); *C10G 2300/1033* (2013.01); *C10G 2300/4006* (2013.01); *C10G 2300/4012* (2013.01); *C10G 2300/4081* (2013.01)

(58) Field of Classification Search
CPC ..... C10G 53/02; C10G 2300/1033; C10G 2300/4006; C10G 2300/4012; C10G 2300/4081
See application file for complete search history.

(56) References Cited

U.S. PATENT DOCUMENTS 7,174,959 B2 2/2007 Pratt
10,995,257 B2 * 5/2021 De Wolf ..... C09K 8/528

OTHER PUBLICATIONS

ABB Gas Oil Separation Plant dated Aug. 2008; retrieved from https://library.e.abb.com/public/728e154e6d97da78c1257b1a005b1769/Oil%20and%20gas%20production%20handbook%20ed1x7a_o.pdf on Nov. 30, 2022.

* cited by examiner

*Primary Examiner* — Ellen M McAvoy
*Assistant Examiner* — Chantel Graham
(74) *Attorney, Agent, or Firm* — Vorys, Sater, Seymour and Pease LLP

(57) ABSTRACT

A method may include producing a crude oil from a reservoir and contacting the crude oil with a demulsifying agent before the crude oil passes through a production choke valve to form a mixture of crude oil and demulsifying agent. The mixture of crude oil and demulsifying agent may be separated in one or more separators into a gas stream, an oil stream, and a water stream. The gas stream and oil stream may be combined to form an oil and gas mixture.

17 Claims, 4 Drawing Sheets

METHODS OF WATER SEPARATION FROM CRUDE OIL

FIELD OF THE DISCLOSURE

The present disclosure relates generally to the separation of water from crude oil and, more particularly, to methods of water separation from crude oil and reinjection of the separated water into reservoirs.

BACKGROUND OF THE DISCLOSURE

Produced water associated with offshore crude oil production can become entrained in the crude oil, resulting in the formation of tight emulsions during pipeline transportation. Tight emulsions of water and crude oil can be challenging to separate. The current practice of transporting crude oil with the entrained produced water to onshore water separation facilities only tightens the emulsions. Subsequently, significant amounts of demulsifier and crude heating are required to break the tight emulsions. Additionally, due to the salt-rich composition of the produced water, transportation pipelines are subject to fouling and corrosion, necessitating frequent maintenance. The aforementioned problems consequently contribute to high capital costs and operating expenditures.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a method may include producing a crude oil from a reservoir and contacting the crude oil with a demulsifying agent before the crude oil passes through a production choke valve to form a mixture of crude oil and demulsifying agent. The mixture may be separated in a high-pressure vessel into a gas stream, an oil stream, and a water stream. The gas stream and oil stream may be combined to form an oil and gas mixture.

In another embodiment, a method may include producing a crude oil from a reservoir and contacting the crude oil with a demulsifying agent before the crude oil passes through a production choke valve to form a mixture of crude oil and demulsifying agent. The mixture may be separated into a separation system into a gas stream, an oil stream, and a water stream. The separation system may include a first separator and a second separator. The gas stream may be combined with the oil stream to form an oil and gas mixture.

In a further embodiment, a method may include producing a crude oil from a reservoir and contacting the crude oil with a demulsifying agent before the crude oil passes through a production choke valve to form a mixture of crude oil and demulsifying agent. The mixture may be separated in a gas-liquid cyclonic separator into a natural gas stream and an oil-water emulsion stream. The oil-water emulsion stream may be further separated in an electrostatic coalescer to form a first two-phase liquid stream. The first two-phase liquid stream may be separated in a liquid-liquid separator into a first liquid crude stream and a second two-phase liquid stream. The second two-phase liquid stream may be separated in a hydrocyclone into a second liquid crude stream and a water stream. The natural gas stream, the first liquid crude stream, and the second liquid crude stream may be combined to form an oil and gas mixture.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
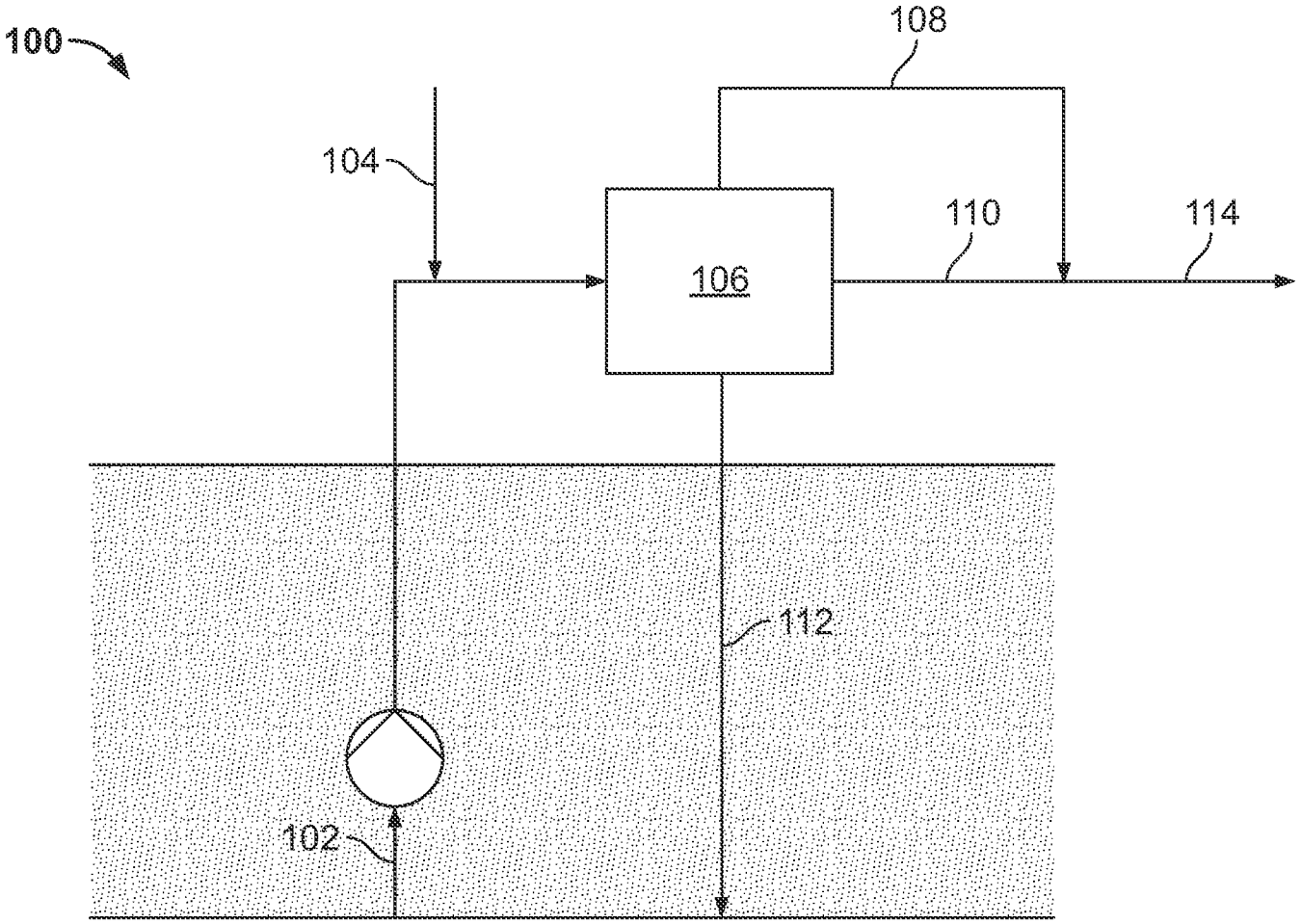
FIG. 1 is a schematic of a method of separating water from crude oil.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to methods of water separation from crude oil at a point in the production before the produced multi-phase crude oil passes through a production choke valve. Processing the multi-phase crude oil to remove at least a portion of the water therein before the production choke valve takes advantage of the relatively higher temperature and pressures, and the resulting looser emulsions that occur before the production choke valve. Water entrained in crude oil produced offshore can become tightly emulsified within pipelines and can be difficult to separate in onshore facilities. Separating the water in-line with the crude oil production process, rather than transferring on-shore may eliminate these difficulties. Additionally, the water separated from the crude may be reinjected into the oil and gas reservoir for enhanced oil and gas recovery.

Figure 2:
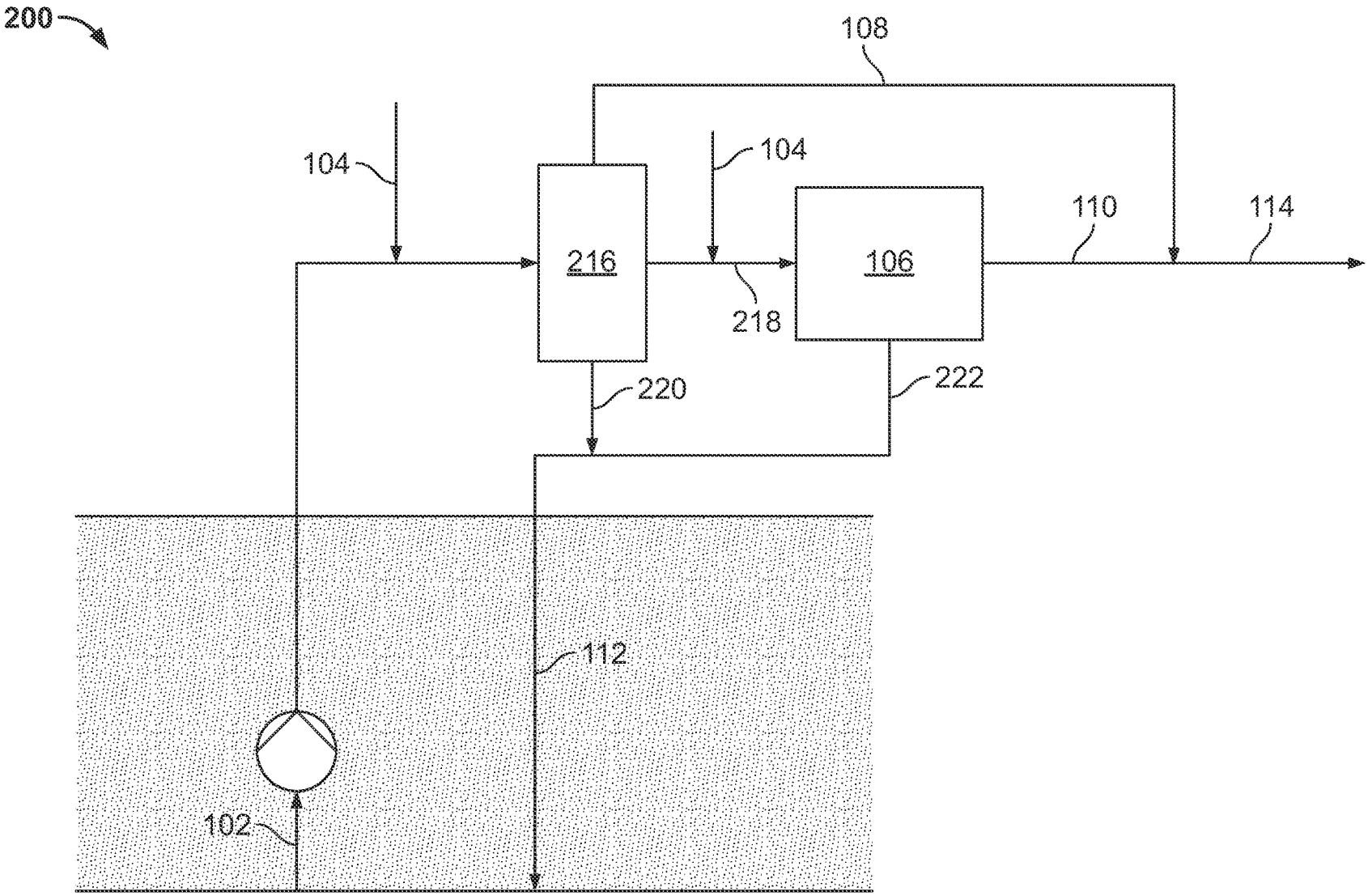
FIG. 2 is a schematic of a two-step water separation method from crude oil.

FIG. 1 illustrates a non-limiting example of a water separation system 100. A stream of crude oil 102 is pumped from an oil and gas reservoir and contacted with a demulsifying agent stream 104. Crude oil 102 is a multi-phase stream that comprises liquid hydrocarbons, gaseous hydrocarbons, and an aqueous component, such as water. The mixture of the crude oil stream 102 and the demulsifying agent stream 104 may be mixed with one or more additional mixtures of crude oil streams and demulsifying agent streams from the reservoir. The mixture of the crude oil stream 102 and demulsifying agent stream 104 is then conveyed to a high-pressure vessel 106. The crude oil stream 102 and demulsifying agent stream 104 may be mixed in a mixing unit (not shown) before entering the high-pressure vessel 106. The high-pressure vessel 106 may separate the mixture of the crude oil stream 102 and demulsifying agent stream 104 into a natural gas stream 108, a liquid crude stream 110, and a water stream 112. If desired, the water stream 112 may be introduced back into the oil and gas reservoir as shown in FIG. 1, alternatively it may be discarded or used in other operations. The natural gas stream 108 and liquid crude stream 110 may be combined to form an oil and gas mixture 114 that may be further processed. Within high-pressure vessel 106 the crude oil mixed with the demulsifying agent is contacted with a coalescer to separate the hydrocarbons (natural gas and liquid crude) from the aqueous liquid (water).

Where the same element numbers are using between the Figures described herein, the described details are the same between those elements. FIG. 2 illustrates another non-limiting example of a water separation system 200. A stream of crude oil 102 is pumped from an oil and gas reservoir and contacted with a demulsifying agent stream 104. The mixture of the crude oil stream 102 and demulsifying agent stream 104 may be conveyed to a free-water separator 216. Free-water separator 216 is preferably a hydrocyclone that separates the components in the crude oil 102 into a natural gas stream 108, a loose oil-water emulsion stream 218, and a first water stream 220. If desired, first water stream 220 may be introduced back into the oil and gas reservoir as shown in FIG. 2, alternatively first water stream 220 may be discarded or used in other operations. In some embodiments, where it is desired to return first water stream 220 back to the oil and gas reservoir, injection pumps may be used to increase the pressure of the returned water, possibly to a pressure of about 1000 psig to about 2500 psig (or about 1000 psig to about 1500 psig, or about 1250 psig to about 1750 psig, or about 1500 psig to about 2000 psig, or about 1750 psig to about 2250 psig, or about 2000 psig to about 2500 psig). Preferably, free-water separator 216 operates at a pressure of between 300-500 psig and a temperature of 150-210° F.

The loose oil-water emulsion stream 218 may be contacted again by with a second demulsifying agent stream 104. The loose oil-water emulsion stream 218 and second demulsifying agent stream 104 mixture may enter a high-pressure vessel 106 and be split into a liquid crude stream 110 and a second water stream 222. The first water stream 220 and the second water stream 222 may be combined into a single water stream 112 and reinjected into the oil and gas reservoir as shown in FIG. 2, alternatively first water stream 220 may be discarded or used in other operations. In some embodiments, where it is desired to return either first water stream 220 and the second water stream 222, or both back to the oil and gas reservoir injection pumps may be used to increase the pressure of the returned water to about 1000 psig to about 2500 psig (or about 1000 psig to about 1500 psig, or about 1250 psig to about 1750 psig, or about 1500 psig to about 2000 psig, or about 1750 psig to about 2250 psig, or about 2000 psig to about 2500 psig). The natural gas stream 108 and the liquid crude stream 110 may be mixed to form an oil and gas mixture 114 that may be further processed.

Figure 3:
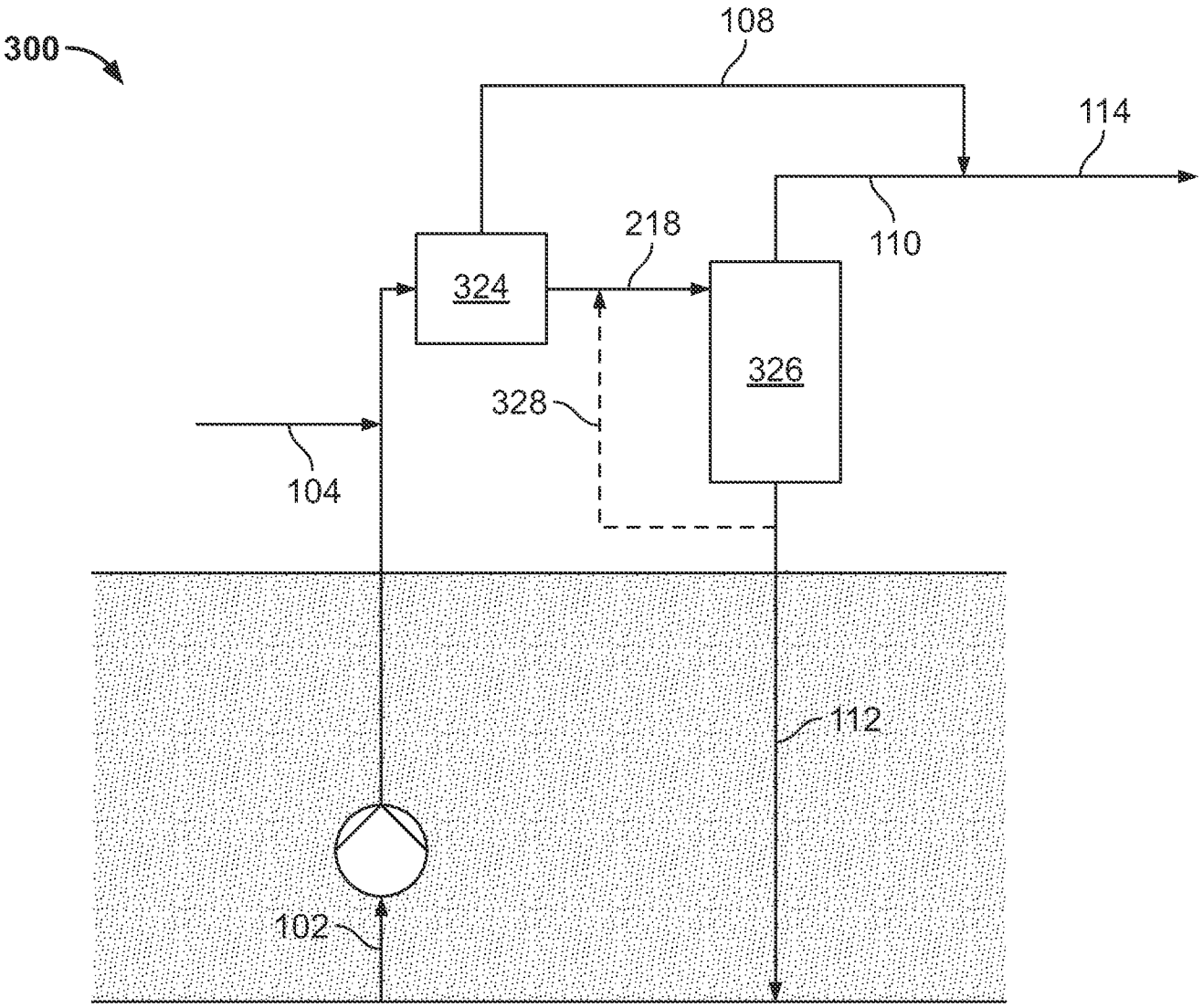
FIG. 3 is a schematic of another two-step water separation method from crude oil.

FIG. 3 illustrates a similar non-limiting example of a water separation system 300. A stream of crude oil 102 is pumped from an oil and gas reservoir and contacted with a demulsifying agent stream 104. The mixture of the crude oil stream 102 and demulsifying agent stream 104 is conveyed to an inline separator 324, preferably a cyclonic separator, that separates the mixture into a natural gas stream 108 and a loose oil-water emulsion stream 218. The loose oil-water emulsion stream 218 is then sent to a separator 326, preferably a deoiling hydrocyclone, that separates the loose oil-water emulsion stream 218 into a liquid crude stream 110 and a water stream 112. At least a portion of the water stream 112 may be optionally recycled to the loose oil-water emulsion stream 218 via stream 328. In some embodiments the remainder of water stream 112 may be reinjected into the oil and gas reservoir, as noted above, injection pumps may be used if desired. The natural gas stream 108 and the liquid crude stream 110 may be mixed to form an oil and gas mixture 114 that may be further processed.

Figure 4:
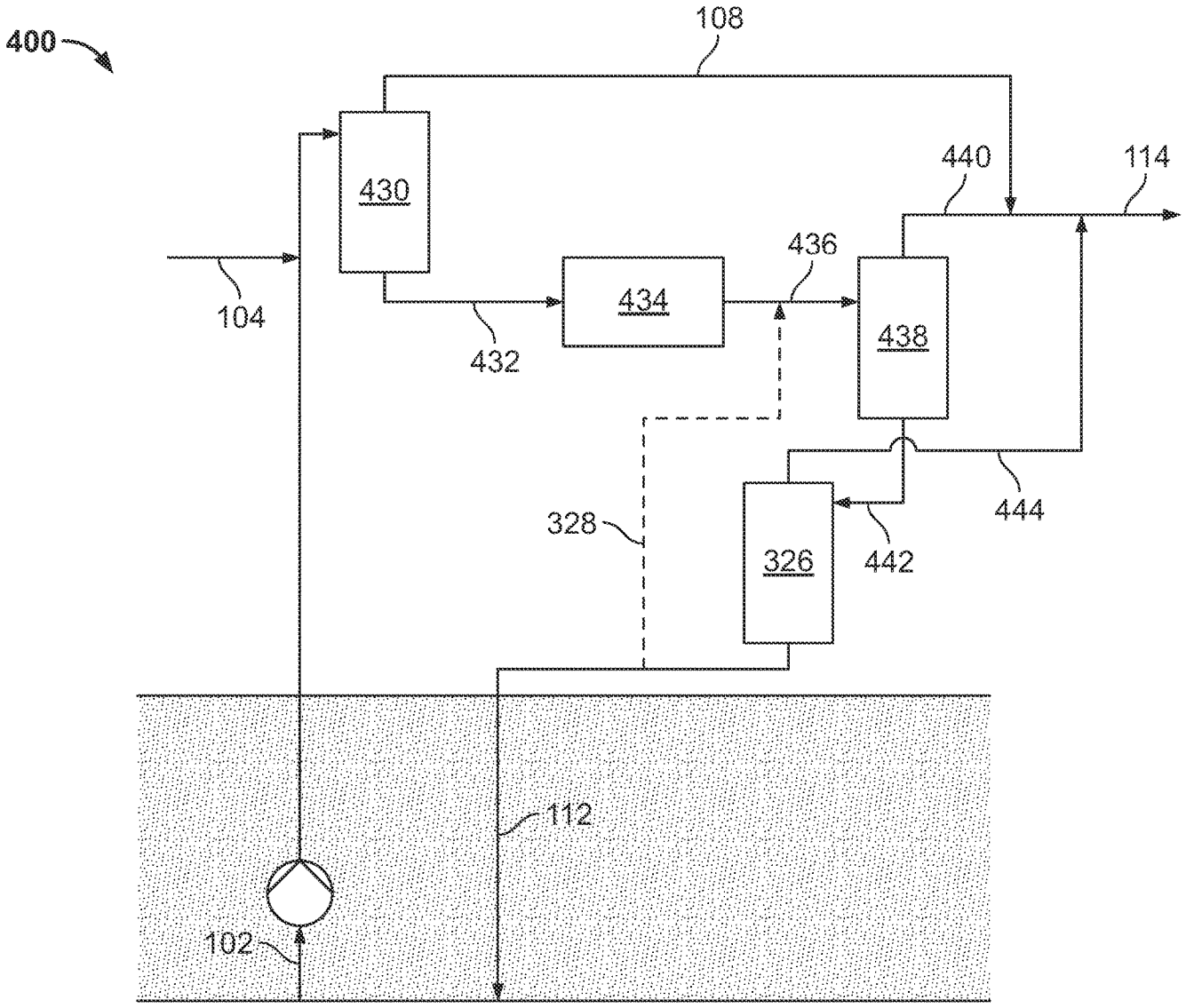
FIG. 4 is a schematic of a multi-step method of separating water from crude oil.

FIG. 4 illustrates a non-limiting example of a multi-step water separation system 400. A stream of crude oil 102 is pumped from an oil and gas reservoir and contacted with a demulsifying agent stream 104. The mixture of the crude oil stream 102 and demulsifying agent stream 104 is then conveyed to a gas-liquid separator 430 that separates the mixture into a natural gas stream 108 and an oil-water emulsion stream 432. Gas-liquid separator 430 is preferably a cyclonic separator optimized to separate two-phase mixtures rather than oil and water mixtures.

The oil-water emulsion stream 432 may be coalesced in an electrostatic coalescer 434 to break the emulsion, forming a first two-phase liquid stream 436. The first two-phase liquid stream 436 may be separated in a liquid-liquid separator 438, preferably a cyclonic or electrostatic separator, into a first liquid crude stream 440 and a second two-phase liquid stream 442 rich in water. The second two-phase liquid stream 442 may be further separated in separator 326, preferably a deoiling hydrocyclone, to obtain a second liquid crude stream 444 and a water stream 112. If desired, a portion of the water stream 412 may be recycled to the first two-phase liquid stream 436 via stream 328. The natural gas stream 108, first liquid crude stream 440, and second liquid crude stream 444 may be combined to form an oil and gas mixture 114 that may be further processed.

FIGS. 1-4 and variations thereof are non-limiting examples of the water separation from crude oil process or portions thereof. Other configurations of various streams (including combining streams before introduction to a component of the process) are contemplated. Some example variations to FIGS. 1-4 are discussed further herein. Additionally, FIGS. 1-4 are general illustrations and other components may be included in the water separation process to ensure the proper and safe operation thereof. Additional components may include, but are not limited to, valves, heat exchangers, pressure meters, flow rate meters, sensors (e.g., pressure sensors, temperature sensors, flow rates sensors), pumps, additional lines (e.g., pipes or conduits for flowing fluids), and the like, and combinations thereof.

The following may provide preferred operating conditions (e.g., temperatures and pressures) for various components and/or streams of the methods of the present disclosure. However, one skilled in the art can appreciate that the operating conditions may vary outside the given ranges based on, for example, location (e.g. offshore vs. onshore), the composition of the crude, and the like.

In one or more instances, the oil and gas reservoir may be at a depth of about 1000 ft to about 10,000 ft (or about 1000 ft to about 5000 ft, or about 2500 ft to about 7500 ft, or about 5000 ft to about 10,000 ft). The crude oil in the reservoir may, for example, be at a pressure of about 1000 psig to about 2500 psig (or about 1000 psig to about 1500 psig, or about 1200 psig to about 2200 psig, or about 2000 psig to about 2300 psig, or about 2100 psig to about 2400 psig, or about 2200 psig to about 2500 psig). The temperature of the crude in the reservoir may, for example, be about 160° F. to about 200° F. (or about 160° F. to about 180° F., or about 170° F. to about 190° F., or about 180° F. to about 200° F.).

The pressure of the crude oil stream 102 may decrease significantly as it travels via production tubing from the reservoir level to where the water separation methods occur. The pressure of the crude oil stream 102 when the demulsifying agent 104 is injected may, for example, be from about 400 psig to about 500 psig (or about 400 psig to about 450 psig, or about 425 psig to about 475 psig, or about 450 psig to about 500 psig). The temperature of the crude oil stream 102 when the demulsifying agent 104 is injected may, for example, be about 150° F. to about 190° F. (or about 150° F. to about 170° F. or about 160° F. to about 180° F., or about 170° F. to about 190° F.).

In one or more instances, the crude oil stream 102 and demulsifying agent stream 104 mixture may be further combined with one or more additional crude oil streams 102 and demulsifying agent streams 104 from the reservoir prior to separation.

Demulsifying agents suitable for use in the water separation methods of the present disclosure may include, but are not limited to, acid-catalyzed phenol-formaldehyde resins, base-catalyzed phenol-formaldehyde resins, epoxy resins, polyethyleneimines, polyamines, di-epoxides, polyols, dendritic molecules, the like, and any combination thereof.

In one or more aspects of the present disclosure, the high-pressure vessel 106 may operate at a pressure of about 400 psig to about 2000 psig (or about 400 psig to about 1000 psig, or about 750 psig to about 1750 psig, or about 1000 psig to about 2000 psig). The pressure of the high-pressure vessel may be controlled by outlet valves including, but not limited to, choke valves.

Furthermore, the high-pressure vessel may operate at a temperature of about, for example, 150° F. to about 190° F. (or about 150° F. to about 170° F. or about 160° F. to about 180° F., or about 170° F. to about 190° F.).

To enhance the coalescence of the entrained water in the crude oil, the high-pressure separator 106 may comprise a coalescer. Examples of coalescers may include, but are not limited to, electrostatic coalescers, mechanical coalescing packing, filter coalescers, the like, and any combination thereof.

Free-water separators suitable for use in the water separation method of the present disclosure may include, but are not limited to, a three-phase vertical or horizontal separator, an inline cyclonic separator, a hydrocyclone, a knockout drum, a liquid centrifuge, the like, and any combination thereof. The free water separator 216 may operate based on the differences in the density of natural gas, liquid crude, and water.

The free-water separator may, for example, operate at a pressure of about 400 psig to about 500 psig (or about 400 psig to about 450 psig, or about 425 psig to about 475 psig, or about 450 psig to about 500 psig). Further, the operating temperature of the free-water separator 216 may, for example, be about 150° F. to about 190° F. (or about 150° F. to about 170° F. or about 160° F. to about 180° F., or about 170° F. to about 190° F.).

The inline separator may, for example, operate at a pressure of about 400 psig to about 500 psig (or about 400 psig to about 450 psig, or about 425 psig to about 475 psig, or about 450 psig to about 500 psig). Further, the operating temperature of the inline separator may, for example, be about 150° F. to about 190° F. (or about 150° F. to about 170° F. or about 160° F. to about 180° F., or about 170° F. to about 190° F.).

The separator 326, preferably a deoiling hydrocyclone, may, for example, operate at a pressure of about 400 psig to about 500 psig (or about 400 psig to about 450 psig, or about 425 psig to about 475 psig, or about 450 psig to about 500 psig). Further, the operating temperature of the deoiling hydrocyclone 326 may, for example, be about 150° F. to about 190° F. (or about 150° F. to about 170° F. or about 160° F. to about 180° F., or about 170° F. to about 190° F.).

Gas-liquid separators suitable for use in the water separation method of the present disclosure may include, but are not limited to, a cyclonic separator, a knockout drum, a centrifugal separator, the like, and any combination thereof. The gas-liquid separator 430 may operate based on the differences in the density of natural gas, liquid crude, and water.

The gas-liquid separator may, for example, operate at a pressure of about 400 psig to about 500 psig (or about 400 psig to about 450 psig, or about 425 psig to about 475 psig, or about 450 psig to about 500 psig). Further, the operating temperature of the gas-liquid separator 430 may, for example, be about 150° F. to about 190° F. (or about 150° F. to about 170° F. or about 160° F. to about 180° F., or about 170° F. to about 190° F.).

In one or more aspects of the present disclosure, the electrostatic coalescer 434 may comprise a settling tank and one or more electrodes to introduce an electric field. The electric field may give rise to attractive forces between the droplets of water entrained in the crude oil and increase the likelihood of coalescence.

Gas-liquid separators 430 suitable for use in the water separation method of the present disclosure may include, but are not limited to, a cyclonic separator, a knockout drum, a centrifugal separator, the like, and any combination thereof. Without being bound by theory, the gas-liquid separator 430 may operate based on the differences in the density of natural gas, liquid crude, and water.

Liquid-liquid separators 438 suitable for use in the water separation method of the present disclosure may include, but are not limited to, a cyclonic separator, a centrifugal separator, an electrostatic coalescer, a filter coalescer, the like, and any combination thereof. The gas-liquid separator 438 may operate based on the differences in the density of liquid crude and water.

The liquid-liquid separator 438 may, for example, operate at a pressure of about 400 psig to about 500 psig (or about 400 psig to about 450 psig, or about 425 psig to about 475 psig, or about 450 psig to about 500 psig). Further, the operating temperature of the liquid-liquid separator 438 may, for example, be about 150° F. to about 190° F. (or about 150° F. to about 170° F. or about 160° F. to about 180° F., or about 170° F. to about 190° F.).

The water stream 112 that is reinjected into the oil and gas reservoir may, for example, be present at a pressure of about 300 psig to about 500 psig (or about 300 psig to about 400 psig, or about 350 psig to about 450 psig, or about 400 psig to about 500 psig). The water stream 112 may, for example, be at a temperature of about 160° F. to about 200° F. (or about 160° F. to about 180° F., or about 170° F. to about 190° F., or about 180° F. to about 200° F.).

In one or more aspects of the present disclosure, the water stream 112 may be reinjected into the reservoir by a water injection pump. The water injection pump may, for example, have a power rating of about 1000 kW to about 8500 kW (or about 1000 kW to about 5000 kW, or about 2500 kW to about 7500 kW, or about 5000 kW to about 8500 kW).

The oil and gas mixture 114 may, for example, be present at a pressure of about 100 psig to about 300 psig (or about 100 psig to about 200 psig, or about 150 psig to about 250 psig, or about 200 psig to about 300 psig). Further, the oil and gas mixture 114 may, for example, be at a temperature of about 160° F. to about 200° F. (or about 160° F. to about 180° F., or about 170° F. to about 190° F., or about 180° F. to about 200° F.).

In one or more examples, the oil and gas mixture 114 may be further processed at a gas-oil separation plant. The gas-oil separation plant may be on- or offsite of the oil and gas reservoir.

In one or more instances, the water separation methods may occur on-site with the crude oil production. The process equipment may be in-line with the oil and gas reservoir.

The water separation methods may, for example, separate about 90% or more by weight of the water entrained in the crude oil at production (or about 90% to about 95%, or about 92% to about 97%, or about 94% to about 99%, or about 95% to about 100%).

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

The terms "crude" and "crude oil" are used interchangeably and both refer to hydrocarbons formed primarily of carbon and hydrogen atoms. The hydrocarbons may also include other elements, such as, but not limited to, halogens, metallic elements, nitrogen, oxygen, or sulfur. Hydrocarbons derived from an oil-bearing formation may include, but are not limited to, kerogen, bitumen, pyrobitumen, asphaltenes, resins, oils, or combinations thereof.

The term "enhanced oil recovery" as used herein refers to the extraction of crude oil by thermal injection, gas injection, or liquid injection.

The term "oil and gas reservoir" and grammatical derivatives thereof refer to a well or reservoir that is a subsurface zone that produces oil and/or gas and lacks communication with other reservoirs. As used herein, "oil and gas well" and "oil and gas reservoir" are interchangeable.

As used herein, the terms "optional" or "optionally" mean that the subsequently described event or circumstance can or cannot occur and that the description includes instances where said event or circumstance occurs and instances where it does not.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A method comprising:

producing a crude oil from a reservoir;

before the crude oil passes through a production choke valve, contacting the crude oil with a demulsifying agent to form a mixture of crude oil and demulsifying agent;

wherein the mixture of crude oil and demulsifying agent is at a pressure of about 400 psig to about 500 psig before the choke valve;

separating the mixture of crude oil and demulsifying agent in a high-pressure vessel into a gas stream, an oil stream, and a water stream; and combining the gas stream and oil stream to form an oil and gas mixture.

2. The method of claim 1, further comprising combining the mixture of crude oil and demulsifying agent with one or more additional mixtures of crude oil and demulsifying agent from the reservoir prior to separation in the high-pressure vessel.

3. The method of claim 1, wherein the high-pressure vessel operates at a temperature of about 150° F. to about 190° F. and comprises an electrostatic coalescer.

4. The method of claim 1, further comprising introducing the water stream back into the reservoir.

5. A method comprising:

producing a crude oil from a reservoir;

before the crude oil passes through a production choke valve, contacting the crude oil with a demulsifying agent to form a mixture of crude oil and demulsifying agent;

wherein the mixture of crude oil and demulsifying agent is at a pressure of about 400 psig to about 500 psig before the choke valve;

separating the mixture of crude oil and demulsifying agent in a separation system into a gas stream, an oil stream, and a water stream, the separation system comprising a first separator and a second separator; and combining the gas stream with the oil stream to form an oil and gas mixture.

6. The method of claim 5, wherein the first separator is a free water separator and the second separator is a high-pressure vessel comprising a coalescer, wherein the free water separator separates into a natural gas stream, a water stream, and a mixture of crude oil and water; and wherein the mixture of crude oil and water is sent to the second separator after leaving the first separator.

7. The method of claim 6, wherein a second demulsifying agent is added to the mixture of crude oil and water before it is sent to the second separator.

8. The method of claim 5, wherein the first separator is an inline separator and the second separator is a hydrocyclone;

wherein the inline separator separates into a natural gas stream and a mixture of crude oil and water;

wherein the mixture of crude oil and water is sent to the second separator after leaving the first separator; and wherein the second separator separates into a liquid crude stream and a water stream.

9. The method of claim 8, further comprising recycling at least a portion of the water exiting the second separator back to the mixture of crude oil and water exiting the first separator.

10. The method of claim 6, wherein the first separator comprises a free water separator, a knockout drum, an inline separator, a hydrocyclone inline separator, or any combination thereof.

11. The method of claim 6, wherein the second separator comprises a high-pressure vessel, a deoiling hydrocyclone, or any combination thereof.

12. The method of claim 11, wherein the high-pressure separator operates at a pressure of about 400 psig to about 2000 psig and a temperature of about 150° F. to about 190° F.

13. The method of claim 12, wherein the high-pressure separator comprises an electrostatic coalescer.

14. The method of claim 6, wherein the oil and gas mixture is at a pressure of about 100 psig to about 300 psig.

15. A method comprising:

producing a crude oil from a reservoir;

before the crude oil passes through a production choke valve, contacting the crude oil with a demulsifying agent to form a mixture of crude oil and demulsifying agent;

wherein the mixture of crude oil and demulsifying agent is at a pressure of about 400 psig to about 500 psig before the choke valve;

separating the mixture of crude oil and demulsifying agent in a gas-liquid cyclonic separator into a natural gas stream and an oil-water emulsion stream;

separating the oil-water emulsion stream in an electrostatic coalescer to form a first two-phase liquid stream;

separating the first two-phase liquid stream in a liquid-liquid separator into a first liquid crude stream and a second two-phase liquid stream;

separating the second two-phase liquid stream in a hydrocyclone into a second liquid crude stream and a water stream; and combining the natural gas stream, the first liquid crude stream, and the second liquid crude stream to form an oil and gas mixture.

16. The method of claim 15, further comprising recycling at least a portion of the water stream to the first two-phase liquid stream 436.

17. The method of claim 16, wherein the oil and gas mixture is at a pressure of about 100 psig to about 300 psig.

* * * * *